US006289967B1

(12) United States Patent
Moore

(10) Patent No.: US 6,289,967 B1
(45) Date of Patent: Sep. 18, 2001

(54) POTPOURRI SHOWER CURTAIN

(76) Inventor: Victoria G. Moore, 6122 Majors La., Columbia, MD (US) 21045

( * ) Notice: Subject to any disclaimer, the term of this patent is extended or adjusted under 35 U.S.C. 154(b) by 0 days.

(21) Appl. No.: 09/473,200

(22) Filed: Dec. 14, 1999

(51) Int. Cl.[7] ..... A47H 1/00

(52) U.S. Cl. ..... 160/330; 160/237; 160/127; 160/DIG. 6

(58) Field of Search ..... 160/330, DIG. 6, 160/237, 127; 4/558, 608

(56) References Cited

U.S. PATENT DOCUMENTS

| | | | | |
|---|---|---|---|---|
| 2,256,917 | | 9/1941 | Woiwode et al. . | |
| 2,752,993 | * | 7/1956 | Scott | 160/330 |
| 3,567,118 | | 3/1971 | Shepherd et al. . | |
| 4,283,011 | | 8/1981 | Spector . | |
| 4,666,670 | | 5/1987 | Cox . | |
| 4,696,844 | | 9/1987 | Spector . | |
| 4,713,291 | | 12/1987 | Sasaki et al. . | |
| 4,905,898 | | 3/1990 | Wade et al. . | |
| 5,355,551 | * | 10/1994 | Schechter et al. | 160/330 X |
| 5,761,751 | * | 6/1998 | Morrissey | 160/DIG. 6 X |
| 5,887,298 | * | 3/1999 | Semidey | 4/661 |
| 5,901,769 | * | 5/1999 | Farley | 160/DIG. 6 X |

* cited by examiner

*Primary Examiner*—David M. Purol
(74) *Attorney, Agent, or Firm*—Arent Fox Kintner Plotkin & Kahn, PLLC

(57) ABSTRACT

A shower curtain made of breathable fabric, which holds replaceable and disposable potpourri sachets. The fragrance is formed by the release of natural scents of potpourri ingredients through sachets comprised of tightly meshed netting. The potpourri sachets are retained within the rotund pockets of the shower curtain, which are sealed with velcro. Fragrance is additionally enhanced by the release of steam from warm shower or bath water saturating the atmosphere, and the bathroom is perfumed by the potpourri sachets. Furthermore, selected potpourri ingredients produce an environment conducive to aromatherapy.

5 Claims, 3 Drawing Sheets

POTPOURRI SHOWER CURTAIN

BACKGROUND OF THE INVENTION

This invention relates to a shower curtain containing potpourri sachets for the purpose of repelling water and perfuming the air.

Shower curtains are commonly in use to confine water in showers and bathtubs. Potpourri is currently in style to emit fragrance into the air. Both articles are designed for decorative purposes. Such shower curtains are poised from a rod above the shower or bathtub. Potpourri is commonly displayed in containers and baskets throughout the bathroom. It is the object of the invention to produce a shower curtain, which contains specially-designed pockets to retain potpourri, utilizing steam from the shower water or bath water to scent the air within the bathroom.

SUMMARY OF THE INVENTION

It has been known for years that there are odors in the air that are offensive to smell. More specifically, the bathroom contains repulsive odors which are derived from mold, mildew and waste dispensed from the human body. Man has attempted to suppress these unpleasant odors by creating deodorizing products.

While potpourri is an effective source of masking and erasing unpleasing odors by perfuming the air, the common methods of using baskets, glass and plastic containers, clay pots and loose sachets to contain this product poses distinct problems.

Glass containers promote safety hazards, in that glass can break and cut the human body. Also, the weight of glass can induce bodily harm when dropped on one's self. Furthermore, glass can "trap" potpourri fragrance, instead of emitting the pleasant scent into the air. Unfortunately, clay containers possess the same risk.

A basket made from wicker or straw generates potpourri "leakage", which creates product waste. Also, it may stain the fixture the basket is placed upon.

Sachets conquer some of these difficulties, in that they release fragrance freely, they cannot break into pieces that may incision the human body, and they are light in weight. Moreover, the elements are environmentally safe. However, potpourri sachets command a secure area for placement, as they can be severely damaged. Excess water will extinguish the scent, while an insecure location may destroy the product.

In observation of the deficiencies of the recognized potpourri embodiments, it is the purpose of the introduced invention to supply a pocketed shower curtain that will repel water and retain potpourri sachets, utilizing the proximity of steam from the warm water to enhance the scent of potpourri into the atmosphere. Thus, the fragrance in the bathroom air will assert an aromatherapy effect.

It is also the object of the invention that the shower curtain be made of a breathable, natural fabric.

It is further the object of the invention that the potpourri sachets be replaceable and possess various scents.

It is yet another object of the invention that the shower curtain and potpourri sachets are constructed to be environmentally friendly.

In accordance with the invention, a shower curtain made of scent-releasing fabric is provided with rotund pockets. The pockets are precisely designed to secure potpourri sachets.

The pouch material is specifically selected to contain and protect the sachet's contents, while releasing fragrance during the time in which the user is taking a warm bath or shower.

The rotund shape is favored to be user-friendly for the purchaser, that is, they will be able to open and close the shower curtain with ease. Also, they are able to obtain and use potpourri sachets from multiple manufacturers.

DESCRIPTION OF THE PREFERRED EMBODIMENT

Figure 1:
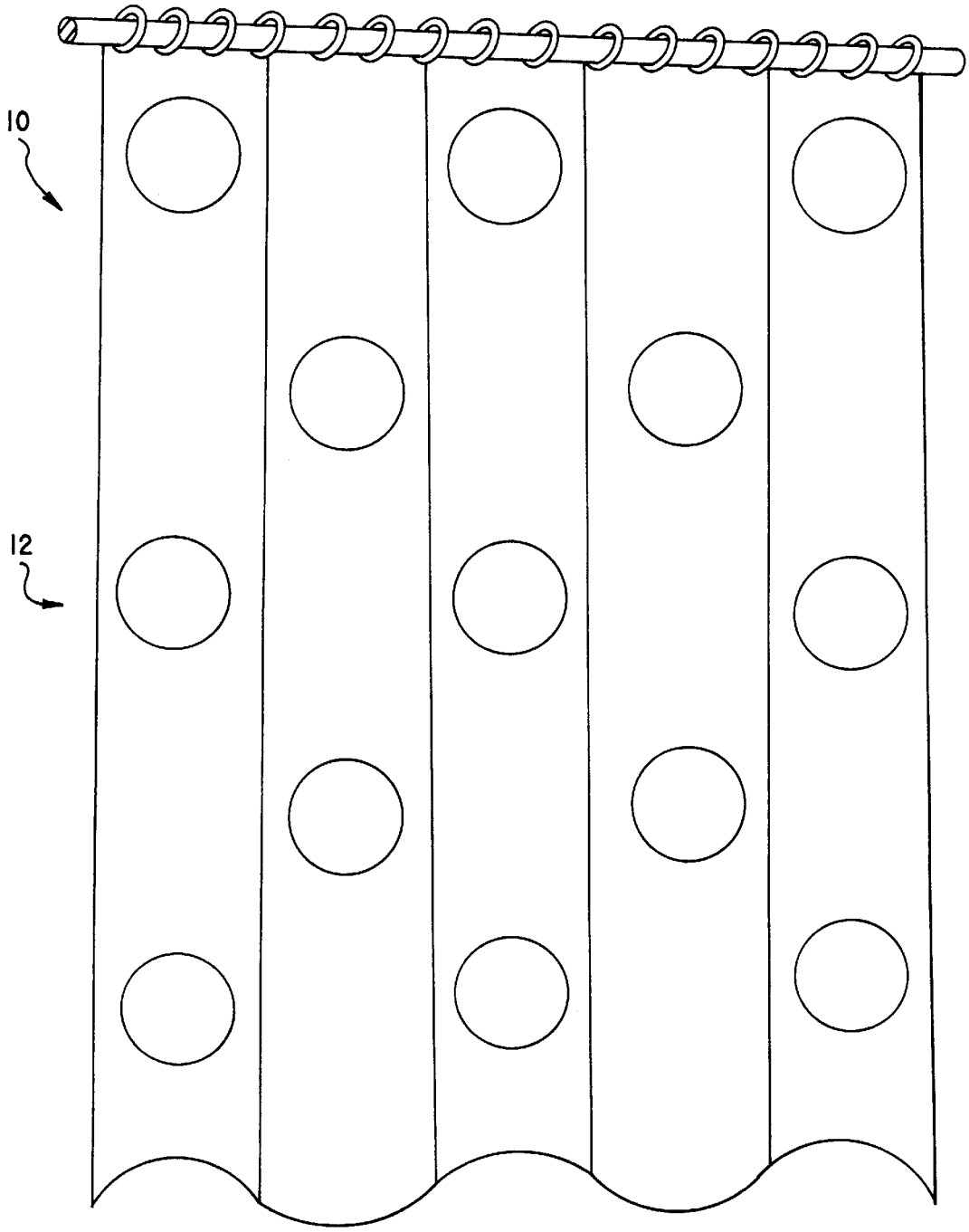
FIG. 1 is a candid expression of a shower curtain accommodating potpourri sachets in accordance with the invention.
Figure 2:
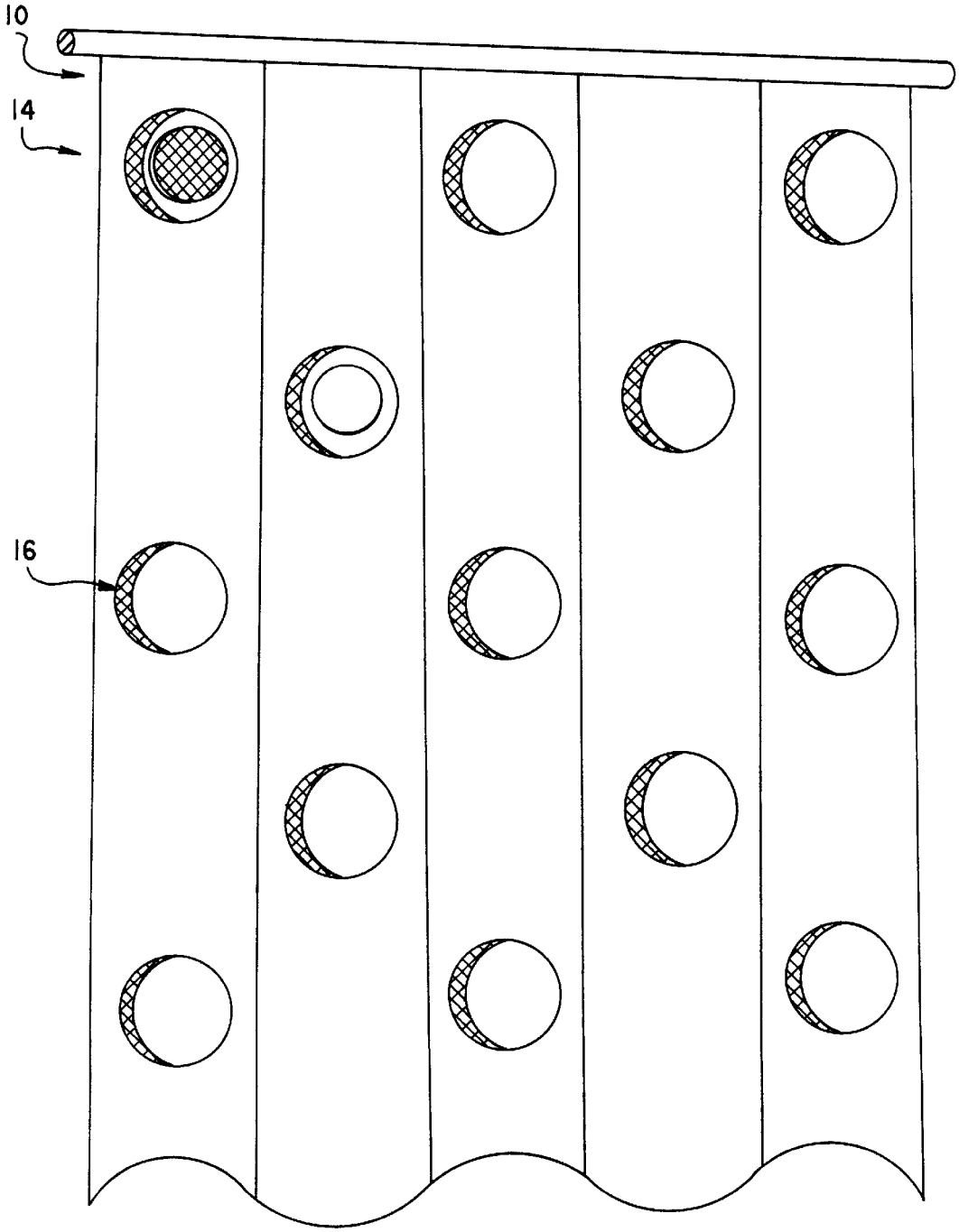
FIG. 2 shows a posterior view of a shower curtain in which potpourri sachets are secured by rotund pockets inside the shower curtain.
Figure 3:
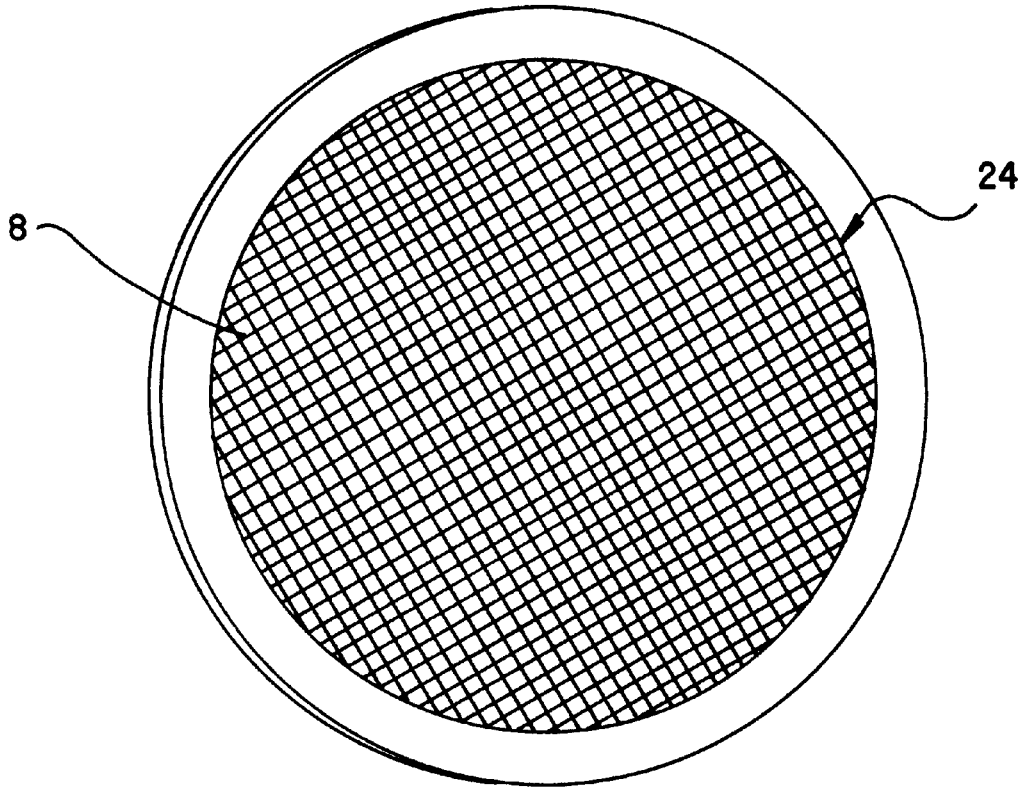
FIG. 3 is an enlarged view of a netted potpourri sachet.

Referring to FIGS. 1 and 2, a cloth shower curtain 10 according to a preferred embodiment is shown. FIG. 2 exhibits rotund pockets that are in a complete circle (14', FIG. 2), or can be any shape of choice. The pockets are open-ended with a velcro strip 16 to permit the insertion of the potpourri sachet (see FIG. 3).

The sachet is comprised of a scent-releasing material, which is netted 8. This material can be of any form whereby fragrance can be released throughout the air and is water resistant. The sachet is thoroughly enclosed 24 to prevent the contents of potpourri from evasion (see FIG. 3).

As seen in FIG. 2 the sachet (FIG. 3) fits securely into the pocket 14 of the backside of the shower curtain 10.

As can be seen from FIG. 1, the front of the shower curtain sustains a sense of style and firmly accommodates the potpourri sachets.

Although the embodiments above are qualified to achieve the principles of the invention, it is to be comprehended that that these embodiments are to be viewed and described for the sole purpose of illustration and not for the purpose of restriction.

What is claimed is:

1. A shower curtain that confines water in either one of a shower and a water tub, the shower curtain comprising:

a shower curtain body;

a plurality of open-ended pockets formed in the shower curtain body; and a plurality of replaceable and disposable sachets, each sachet having a first netted side joined to a second netted side to form an enclosed packet and is configured to securely fit within a corresponding pocket, wherein the enclosed packet of each sachet is filled with a scented material that emits a fragrance.

2. The shower curtain according to claim 1, wherein each pocket further comprises an open end and a hook and loop fastener that is used to open and close the open end of each pocket.

3. The shower curtain according to claim 1, wherein the scented material is potpourri.

4. The shower curtain according to claim 1, wherein each pocket is rotund shaped.

5. The shower curtain according to claim 1, wherein the first and second netted sides of each sachet are meshed.

* * * * *